US005269419A

United States Patent [19]

Aldeguer et al.

[11] Patent Number: 5,269,419

[45] Date of Patent: Dec. 14, 1993

[54] MODULAR SHELF SYSTEM

[75] Inventors: René Aldeguer, Lyons; Maurice Revelli, Pierre Benite; Michel Vardas, Mezeriat, all of France

[73] Assignee: Ets Morice et Cie Traitogaz, Miribel, France

[21] Appl. No.: 893,514

[22] Filed: Jun. 3, 1992

[30] Foreign Application Priority Data

Jun. 3, 1991 [FR] France ..... 91 07260

[51] Int. Cl.[5] ..... A47B 47/04

[52] U.S. Cl. ..... 211/188; 211/186; 211/182; 108/111

[58] Field of Search ..... 211/188, 186, 194, 189, 211/182; 108/108, 111, 153

[56] References Cited

U.S. PATENT DOCUMENTS

| | | | |
|---|---|---|---|
| 3,517,828 | 6/1970 | Hunter | 211/194 |
| 3,674,229 | 7/1972 | Keeler, II | 211/188 |
| 3,857,494 | 12/1974 | Giardini | 211/194 |
| 4,953,719 | 9/1990 | Spamer | 211/188 |
| 5,048,702 | 9/1991 | Maloney | 211/194 |

FOREIGN PATENT DOCUMENTS

| | | |
|---|---|---|
| 0410325A2 | 1/1991 | European Pat. Off. . |
| 2021201 | 4/1970 | Fed. Rep. of Germany . |
| 2497647 | 1/1981 | France . |
| 6707522 | 12/1968 | Netherlands . |

*Primary Examiner*—Mark Rosenbaum
*Assistant Examiner*—Chuck Y. Mah
*Attorney, Agent, or Firm*—Herbert Dubno; Andrew Wilford

[57] ABSTRACT

A modular shelf system has normally upright tubular post parts each extending along a post axis and having an upper end and a lower end with one end of each post part formed with an axially projecting tapered pin and the other end of each post part formed with an axially open complementarily tapered seat. Main longitudinal beams have ends each having an upper side and a lower side with one side of each longitudinal-beam end formed with a vertically projecting tapered pin generally identical to the post-part pins and the other side of each longitudinal-beam end formed with an vertically oppositely open complementarily tapered seat generally identical to the post-part seats. Similarly, transverse beams have ends each having an upper side and a lower side with one side of each transverse-beam end formed with a vertically projecting tapered pin generally identical to the post-part pins and the other side of each transverse-beam end formed with an vertically oppositely open complementarily tapered seat generally identical to the post-part seats so that the ends of the beams and the post parts can be interfit to form a three-dimensional rack. Panels shaped to fit with the beams of the rack complete the assembly.

15 Claims, 5 Drawing Sheets

MODULAR SHELF SYSTEM

FIELD OF THE INVENTION

The present invention relates to a shelf system. More particularly this invention concerns a shelf system made of modular components so it can be adapted to different layouts and that is particularly useful in the restaurant or food business.

BACKGROUND OF THE INVENTION

A standard modular shelf arrangement includes normally metal ladders that are interconnected with longitudinal beans on which rest metallic panels to form a rigid three-dimensional structure. Such systems are not readily adaptable, with the vertical shelf spacing determined by the vertical spacing of the ladder rungs.

In other known systems molded plastic elements are used that are constituted basically as flat panels with coupling formations in their corners and post parts that can fit between the corners of superposed panels to form the desired three-dimensional structure. While there is no theoretical limit to the height of such an arrangement, it is normally impossible to neatly join adjacent such structures to form a very long shelf; instead adjacent such shelf units are simply formed and fastened together after assembly. Furthermore these arrangement are not normally very robust or very stable.

OBJECTS OF THE INVENTION

It is therefore an object of the present invention to provide an improved modular shelf system.

Another object is the provision of such an improved modular shelf system which overcomes the above-given disadvantages, that is which can be made of virtually any height or length, and that is very robust.

SUMMARY OF THE INVENTION

A modular shelf system has according to the invention normally upright tubular post parts each extending along a post axis and having an upper end and a lower end with one end of each post part formed with an axially projecting tapered pin and the other end of each post part formed with an axially open complementarily tapered seat. Main longitudinal beams have ends each having an upper side and a lower side with one side of each longitudinal-beam end formed with a vertically projecting tapered pin generally identical to the post-part pins and the other side of each longitudinal-beam end formed with an vertically oppositely open complementarily tapered seat generally identical to the post-part seats. Similarly, transverse beams have ends each having an upper side and a lower side with one side of each transverse-beam end formed with a vertically projecting tapered pin generally identical to the post-part pins and the other side of each transverse-beam end formed with an vertically oppositely open complementarily tapered seat generally identical to the post-part seats so that the ends of the beams and the post parts can be interfit to form a three-dimensional rack. Panels shaped to fit with the beams of the rack complete the assembly.

With this arrangement it is therefore possible to make a shelf system of virtually any height and length. The tapered coupling formations ensure a very solid interfitting of the parts so that the assembly is extremely rigid. In addition the tapered coupling formations can be mated without the use of tools. Forming them is fairly simple because according to the invention the post parts, beams, and panels are all formed of molded plastic and the pins and seats of the beams are unitary with the beams.

In accordance with another feature of the invention each post part has a tubular outer wall, a tubular core tube within the wall and having an upper end forming the respective seat and a lower end extended as and forming the respective pin, and reinforcing webs radially unitarily interconnecting the respective outer wall and core tube. This is an extremely rigid structure. The outer wall of each post part has an upper end and a lower end that can interfit with the respective lower and upper ends of overlying such post parts. At least some of the ribs have lower edges that project axially downward past the respective outer wall and at least some of the seats are formed with radially inwardly open notches into which the lower edges can engage. This ensures accurate positioning of the elements relative to each other angularly of the post axes.

Furthermore according to the invention each longitudinal and transverse beam has an elongated and straight central portion. The transverse beam ends are offset transversely down from the respective central portions with the pin and seat of each transverse-beam end aligned along a normally upright axis coinciding with the respective post-part axes. Furthermore the longitudinal-beam ends have a vertical height that is substantially equal to the vertical offset of the transverse-beam ends from the transverse-beam central portions. Thus the central portions of the longitudinal and transverse beams will be in the same horizontal plane so that the panels, which normally have at least planar rims, can rest solidly ôn the beams.

To adapt the system to different layouts, end longitudinal beams are used that each have one end having an upper side and a lower side with one side of each end-longitudinal-beam end formed with a vertically projecting tapered pin generally identical to the post-part pins and the other side of each end-longitudinal-beam end formed with an vertically oppositely open complementarily tapered seat generally identical to the post-part seats. The one end further is unitarily formed with a downwardly tapered and longitudinally directed coupling formation. The opposite end of such an end longitudinal beam is formed with a complementary downwardly tapered coupling formation. Furthermore intermediate longitudinal beams are provided each having opposite ends each formed with such a downwardly tapered coupling formation. The combination of different beams means that at any panel corner there need only be one post, as at each corner two longitudinal beams will meet one of which is provided with a pin and seat and the other of which is not. The coupling formations are formed as interfitting grooves and ridges and at least some of the longitudinal beams are formed intermediate their ends in their central portions with laterally projecting such coupling formations.

For rigidity each central portion is downwardly U-shaped and is formed with transverse reinforcing webs. The central portions of the beams are formed with longitudinally extending and upwardly open grooves into which outer edges of the panels fit.

In addition the system has according to the invention feet each having an upper end provided with a formation complementary to the formations of the lower sides of the transverse beams and lower ends adapted to engage a floor. The feet lower ends are provided with vertically extending adjustment screws. Cap covers engaged with the ends of some of the beams cover any unneeded coupling formations.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
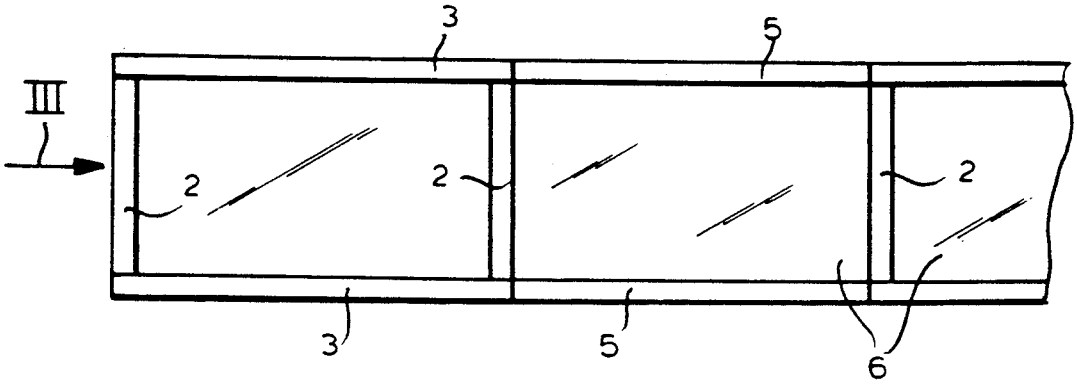
FIGS. 1 and 2 are small-scale top views of shelf systems according to the invention.
Figure 2:
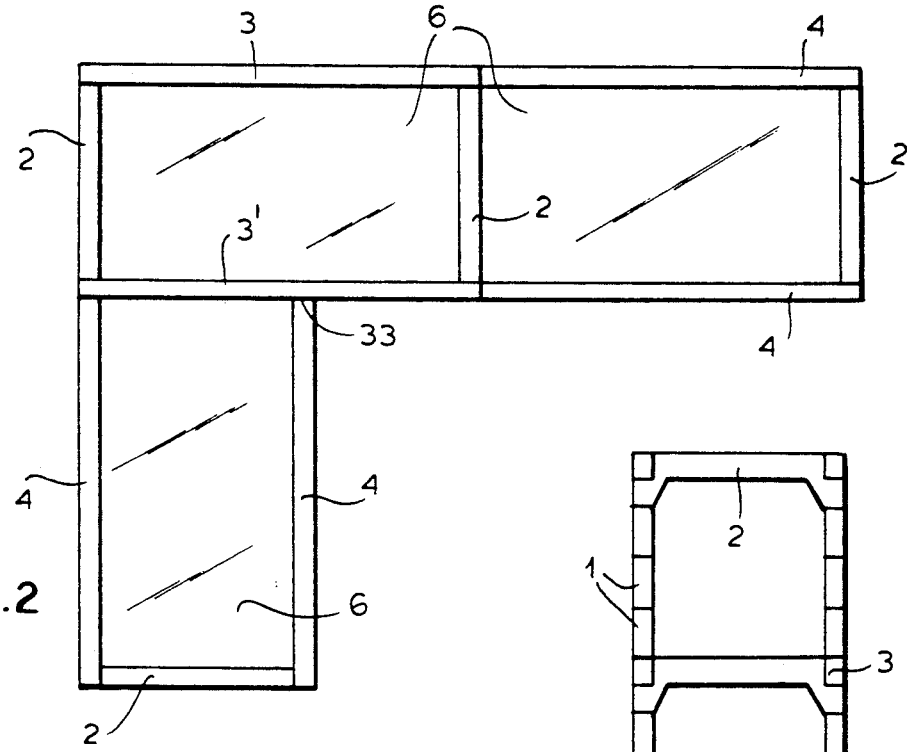
Figure 3:
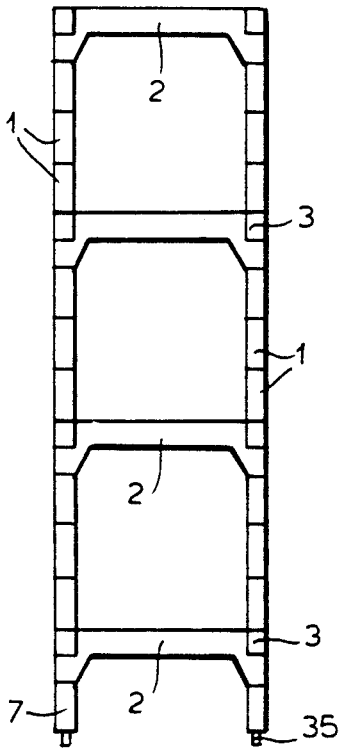
FIG. 3 is an end view taken in the direction of arrow III of FIG. 1.

As seen in FIGS. 1 through 3 the instant invention is a shelf formed by vertical post parts 1, transverse beams 2, main longitudinal beams 3, end longitudinal beams 4, intermediate or bridge longitudinal beams 5, and panels 6. These elements 1–6 are all made of glass-fiber-reinforced polypropylene. The panels 6 can be flat sheets or can be formed as basins or constituted of a mesh, so long as their outer rims are rectangular and planar. The post parts 1 are fitted longitudinally into one another and are provided on their lower ends with floor-engaging feet 7.

As seen in FIGS. 4 through 7 each post part 1 comprises a cruciform-section tubular outer wall 8 and a circular-section core tube 10 interconnected by radially and longitudinally extending integral ribs 9. The entire part 1 is centered on a normally vertical axis 11 and the tube 10 is extended at its lower end as a male coupling formation or pin 12 of downwardly tapering frustoconical shape and forms at its upper end a female coupling formation or seat 13 of complementary shape. The lower end of the outer wall 8 is formed along its inner edge with a cutout 14 and the upper end is formed along its outer edge with a complementary cutout 15 so that two of these parts 1 can be fitted vertically together with the cutouts 14 and 15 interfitting and the ends overlapping. Furthermore the lower ends of two diametrically opposite ribs 9 are extended at lower edges 16 and the upper end of the seat 13 is formed with complementary radially inwardly open grooves 32 that ensure perfect angular alignment of interfitting parts 1.

Each of the identcal transverse beams 2 has an inverted U-section central portion 17 bridged by transverse reinforcement struts or webs 19. Each end 18 of each beam 2 is offset downward from the respective central portion 17 and is formed with an upwardly open and downwardly tapered seat 20 and a downwardly tapering male pin 21 centered on a normally vertical axis 22 just like the seat 13 and pin 12 of the part 1. The end 18 is offset to form a seat or notch 29 for receiving an end of a longitudinal beam 3 or 4 as described below. The longitudinally outwardly directed end face of each end of the central portion 17 of each beam 2 is formed with another seat or coupling formation 27 that is an upwardly flared dovetail groove that can fit with a complementary ridge formation on the side of an interfitting beam 3, 4, or 5.

Figure 9:
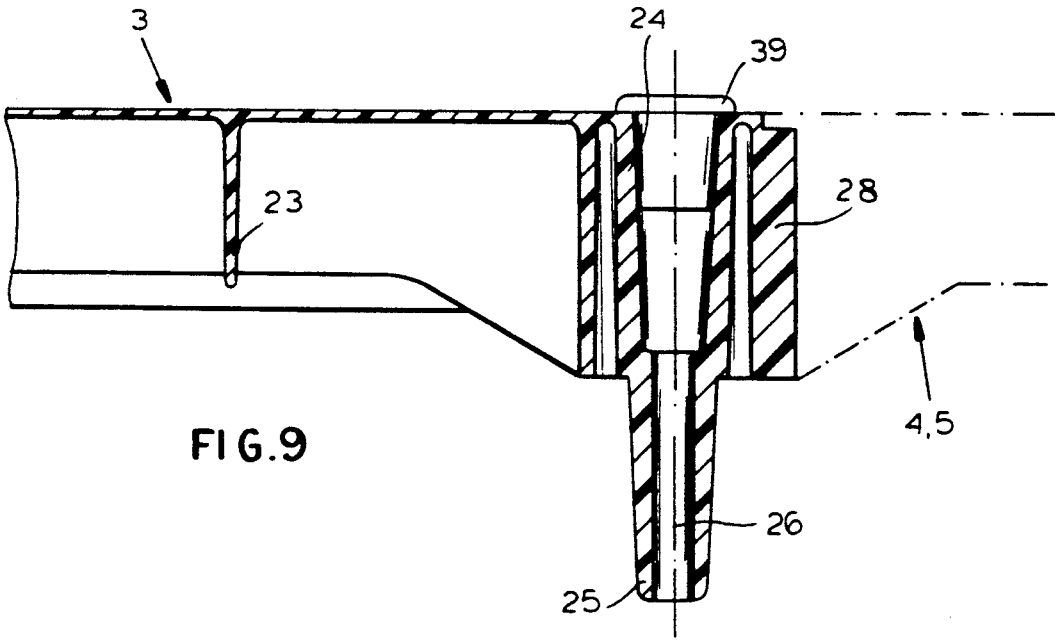
Figure 10:
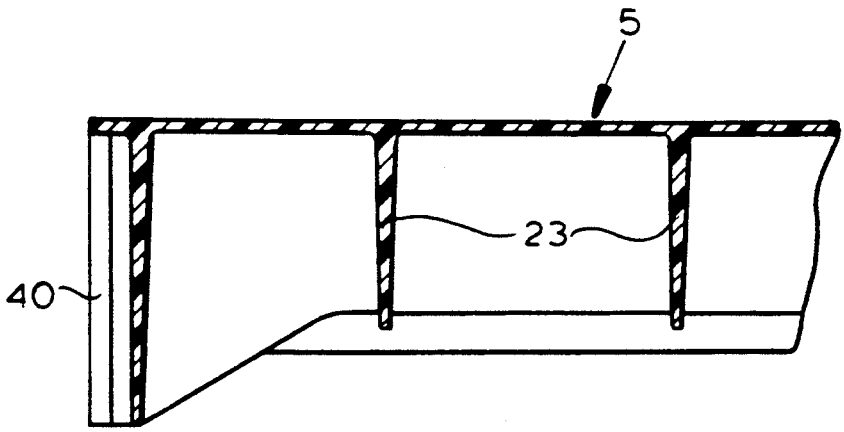
FIG. 10 is a vertical section through the end of another longitudinal beam according to the invention.

Both ends of each beam 3 and one end of each bean 4 are formed as shown in FIG. 9 with an upwardly open frustoconical seat 24 and a downwardly projecting frustoconical pin 25 both centered on an axis 26. This beam 3 has transverse reinforcing webs 23 and a longitudinal outer end formed with a downwardly tapering dovetail groove 28. The other end of the beam 4 and both ends of each beam 5 are formed as shown in FIG. 10 with a downwardly tapering dovetail ridge 40 that can fit complementarily in the groove 28.

Figure 4:
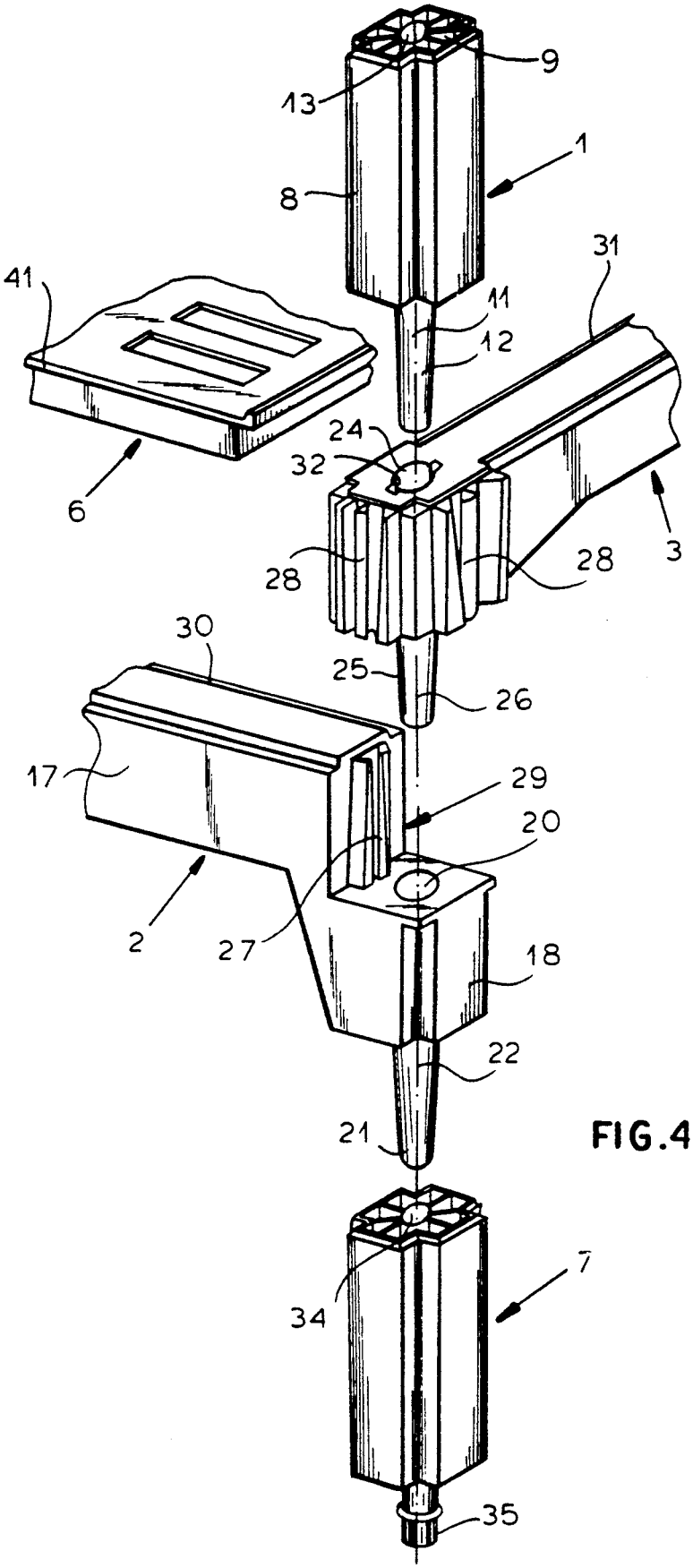
FIG. 4 is an exploded perspective view of a detail of the shelf system.
Figure 5:
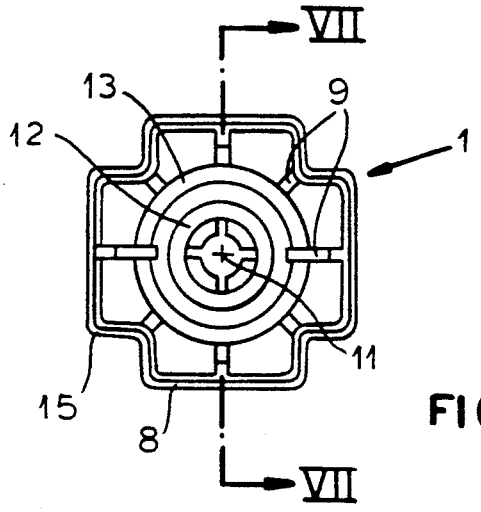
FIG. 5 is a top view of a post part of the shelf system.
Figure 6:
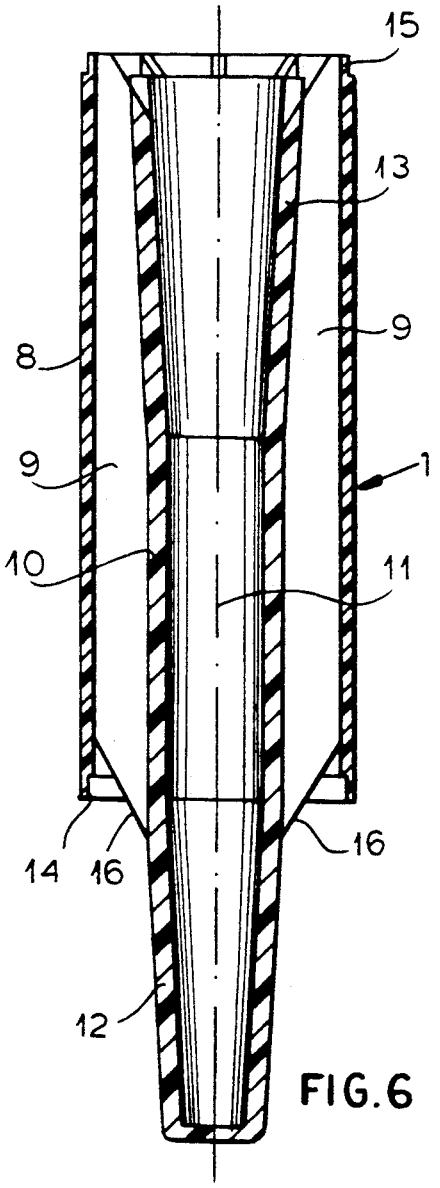
FIGS. 6 and 7 are section taken along respective lines VI—VI and VII—VII of FIG. 5.
Figure 7:
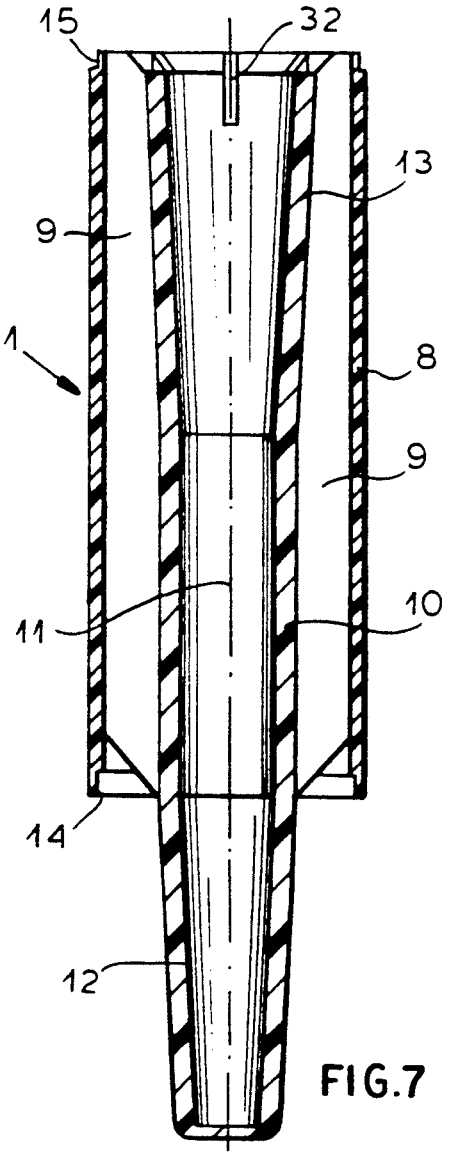
Figure 8:
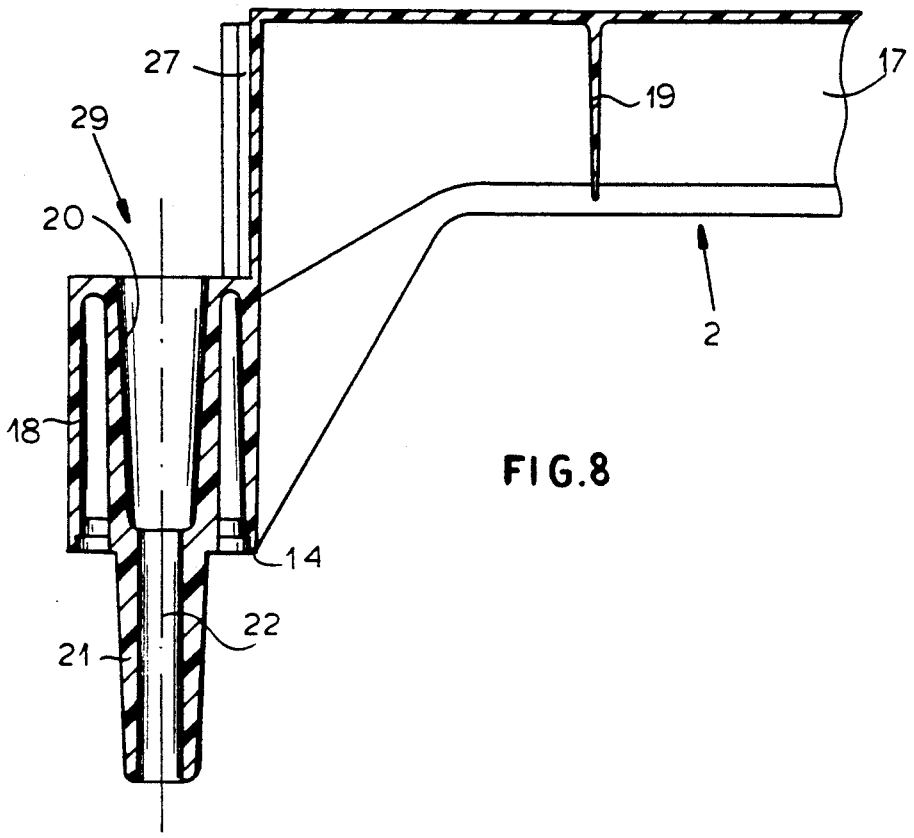
FIGS. 8 and 9 are vertical sections through the end of a transverse beam and of a longitudinal beam, respectively.

Both edges of each beam 2 are formed with a longitudinal groove 30 and both edges of each beam 3, 4, and 5 are formed with a longitudinal groove 31 to receive a lip 41 formed at the edge of each panel 6 as seen in FIG. 4. In addition it is possible to provide or form a beam 3' otherwise identical to the beam 3 with a side seat 33 formed like the seat 28 so that the end of a bridge beam 4 as shown in FIG. 1 can fit in it, making an L-shaped shelf system.

Figure 11:
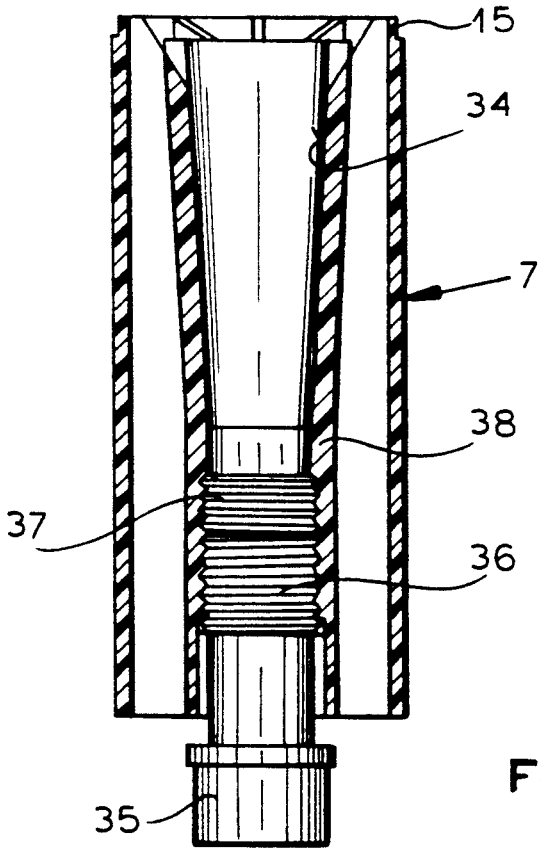
FIG. 11 is a vertical section through a foot according to the invention.

FIG. 11 shows that the foot 7 has an upwardly open seat 34 identical to the seats 13, 20, and 24 and is formed with a downwardly open bore 38 formed with a screwthread 37 into which is screwed an upper threaded part 36 of a floor- or ground-engaging screw 35. This foot 7 therefore elevates the lowermost shelf panel 6 off the ground for sanitary purposes and to make stocking the lowermost shelf easier, and the screw 35 can be adjusted to compensate for a nonlevel support surface. In addition a cap such as shown at 39 in FIG. 9 can be fitted to any seat 13, 20, or 24 that is not in use, and a similar such cover can be fitted over any coupling formation 27, 28, or 40 that is similarly not used.

With this system it is therefore possible to form a simple one-bay shelf system using the elements 1, 2, 3, 6, and 7. A two- or three-bay system is made of the same parts plus some end beams 4. The beams 5 are used in a multiple-bay system where beams 3 are used on both ends. A corner beam 3' is used wherever two shelf systems are to be coupled together at a right angle. Any system requires at least the elements 1, 2, 3, 6, and 7.

We claim:

1. A modular shelf system comprising:

normally upright tubular post parts each extending along a post axis and having an upper end and a lower end, one end of each post part being formed with an axially projecting tapered pin and the other end of each post part being formed with an axially open complementarily tapered seat;

main longitudinal beams having ends each having an upper side and a lower side, one side of each longitudinal-beam end being formed with a vertically projecting tapered pin generally identical to the post-part pins and the other side of each longitudinal-beam end being formed with an vertically oppositely open complementarily tapered seat generally identical to the post-part seats;

transverse beams having ends each having an upper side and a lower side, one side of each transverse-beam end being formed with a vertically projecting tapered pin generally identical to the post-part pins and the other side of each transverse-beam end being formed with an vertically oppositely open complementarily tapered seat generally identical to the post-part seats, whereby the ends of the beams and the post parts can be interfit to form a three-dimensional rack; and panels shaped to fit with the beams of the rack.

2. The modular shelf system defined in claim 1 wherein the post parts, beams, and panels are all formed of molded plastic and the pins and seats of the beams are unitary with the beams.

3. The modular shelf system defined in claim 1 wherein each post part has a tubular outer wall, a tubular core tube within the wall and having an upper end forming the respective seat and a lower end extended as and forming the respective pin, and reinforcing webs radially unitarily interconnecting the respective outer wall and core tube.

4. The modular shelf system defined in claim 3 wherein the outer wall of each post part has an upper end and a lower end that can interfit with the respective lower and upper ends of overlying such post parts.

5. The modular shelf system defined in claim 3 wherein at least some of the webs have lower edges that project axially downward past the respective outer wall, at least some of the seats being formed with radially inwardly open notches into which the lower edges can engage.

6. The modular shelf system defined in claim 1 wherein each longitudinal and transverse beam has an elongated and straight central portion, the transverse beam ends being offset transversely from the respective central portions with the pin and seat of each transverse-beam end aligned along a normally upright axis coinciding with the respective post-part axes.

7. The modular shelf system defined in claim 6 wherein the longitudinal-beam ends have a vertical height that is substantially equal to the vertical offset of the transverse-beam ends from the transverse-beam central portions.

8. The modular shelf system defined in claim 6, further comprising:

end longitudinal beams each having one end having an upper side and a lower side, one side of each end-longitudinal-beam end being formed with a vertically projecting tapered pin generally identical to the post-part pins and the other side of each end-longitudinal-beam end being formed with an vertically oppositely open complementarily tapered seat generally identical to the post-part seats, the one end further being unitarily formed with a downwardly tapered coupling formation, and an opposite end formed with a complementary downwardly tapered coupling formation; and intermediate longitudinal beams each having opposite ends each formed with such a downwardly tapered coupling formation.

9. The modular shelf system defined in claim 8 wherein the coupling formations are formed as interfitting grooves and ridges.

10. The modular shelf system defined in claim 8 wherein at least some of the longitudinal beams are formed intermediate their ends in their central portions with laterally projecting such coupling formations.

11. The modular shelf system defined in claim 6 wherein each central portion is downwardly U-shaped and is formed with transverse reinforcing webs.

12. The modular shelf system defined in claim 6 wherein the central portions of the beams are formed with longitudinally extending and upwardly open grooves into which outer edges of the panels fit.

13. The modular shelf system defined in claim 1, further comprising feet each having an upper end provided with a formation complementary to the formations of the lower sides of the transverse beams and lower ends adapted to engage a floor.

14. The modular shelf system defined in claim 13 wherein the lower ends of said feet are provided with vertically extending adjustment screws.

15. The modular shelf system defined in claim 1, further comprising cap covers engaged with the ends of some of the beams.

* * * * *